US005353707A

United States Patent [19]

Duguet

[11] Patent Number: 5,353,707

[45] Date of Patent: Oct. 11, 1994

[54] PRIMING CHARGE WITH ANNULAR PERCUSSION AND PROCESS FOR ITS MANUFACTURE

[75] Inventor: Jean-René Duguet, Orry-La-Ville, France

[73] Assignee: NCS Pyrotechnie et Technologies, Fosses, France

[21] Appl. No.: 93,820

[22] Filed: Jul. 19, 1993

[30] Foreign Application Priority Data

Jul. 20, 1992 [FR] France ..... 92 08945

[51] Int. Cl.[5] ..... C06D 5/06; C06B 25/34

[52] U.S. Cl. ..... 102/290; 149/92

[58] Field of Search ..... 102/290; 149/92

[56] References Cited

U.S. PATENT DOCUMENTS

| | | | |
|---|---|---|---|
| 3,135,636 | 6/1964 | McGirr | 149/23 |
| 3,321,343 | 5/1967 | Staba | 149/24 |
| 3,423,259 | 1/1969 | Staba | 149/24 |
| 4,142,927 | 3/1979 | Walker et al. | 149/92 X |
| 4,406,210 | 9/1983 | Baker et al. | 149/92 X |
| 4,503,229 | 3/1985 | Willer | 149/92 X |
| 4,689,185 | 8/1987 | Lopata et al. | 264/3.4 |
| 5,039,812 | 8/1991 | Norris | 149/92 X |
| 5,088,412 | 2/1992 | Patrichi | 149/37 X |

FOREIGN PATENT DOCUMENTS

| | | |
|---|---|---|
| 0334725 | 9/1989 | European Pat. Off. . |
| 0440873 | 8/1991 | European Pat. Off. . |

*Primary Examiner*—Peter A. Nelson

*Attorney, Agent, or Firm*—Blakely, Sokoloff, Taylor & Zafman

[57] ABSTRACT

The present invention relates to a priming charge with annular percussion, free from any toxic metal, which corresponds to the following weight composition:

40 to 70% of a dinitrobenzofuroxan salt as impact-sensitive primary explosive,
3 to 15% of tetrazene as sensitizing explosive,
10 to 30% of cupric oxide as oxidizing agent,
5 to 25% of a pulverulent reducing agent,
0.5 to 20% of an inert abrasive powder and
0 to 5% of a binder.

It also relates to a process for its manufacture, wherein the following successive stages are carried out:

the cupric oxide and the pulverulent reducing agent and the inert abrasive powder are mixed dry;
the dinitrobenzofuroxan salt and the tetrazene are then added to this mixture thus formed, and
the mixture thus obtained is homogenized.

If appropriate, a solution of binder, for example in the form of an aqueous solution of gum arabic, is added to the inert mixture.

16 Claims, No Drawings

PRIMING CHARGE WITH ANNULAR PERCUSSION AND PROCESS FOR ITS MANUFACTURE

The present invention relates to new priming charges with annular percussion and to the process for their manufacture.

It is known that percussion priming charges intended to ensure the ignition of propellent powders in firing and sealing cartridges, and generally in all devices producing a flame starting with the action of a striker, exhibit, most of the time, the disadvantage of containing toxic compounds.

A first solution enabling this problem of toxicity to be solved was provided by the Applicant Company and is to be found set out in European Patent Application EP-A-0,334,725. It involves essentially a charge free from any toxic metal, in which the impact-sensitive primary explosive is based on diazodinitrophenol.

Such compositions have proved to be perfectly satisfactory when employed for priming charges with central percussion; on the other hand, they did not provide sufficient sensitivity in the case of an annular priming.

One explanation for this difference in behavior may be in the fact that the explosive composition is more greatly compressed within primers with central percussion, whereas it is only lightly packed in the annular rim of annular percussion cartridge cases.

It could therefore be thought that, while the questions of toxicity could be solved, on the contrary, this was not so with the problems connected with insufficient sensitivity, probably due to a lack of compactness of the charges in arrangements with annular percussion.

It has been found, completely unforeseeably, that this problem could be solved by making use of a mixture of a dinitrobenzofuroxan salt and of tetrazene, as an impact-sensitive explosive, whereas in the state of the art the use of dinitrobenzofuroxan or of one of its salts was generally envisaged only in electrical priming devices or possibly from the viewpoint of an impact-sensitive added explosive, but in this case necessarily in the presence of another major explosive, in particular diazodinitrophenol.

Of course, the dinitrobenzofuroxan salt cannot be employed in any proportions whatever or else in combination with any other explosive whatever. Extensive research has finally made it possible to establish what were the essential characteristics needed to make up a priming charge composition which, on the one hand, do not give rise to any emission of toxic residues released into the atmosphere when the cartridges are fired and, on the other hand, are endowed with a sufficient, but not excessive, sensitivity to percussion, giving them a satisfactory functioning.

Such a priming charge composition with annular percussion in accordance with the present invention contains, expressed on a weight basis:

40 to 90% of an explosive mixture of a dinitrobenzofuroxan salt and of tetrazene,
5 to 30% of a pulverulent oxidizing agent,
5 to 25% of a pulverulent reducing agent,
0 to 25% of an inert abrasive powder, and
0 to 5% of a binder.

According to another characteristic of the present invention the dinitrobenzofuroxan salt preferably consists of a salt of an alkali or alkaline-earth metal, in particular its potassium salt.

It is clear that the priming composition with annular percussion according to the present invention must indispensably include by way of explosives a mixture of a dinitrobenzofuroxan salt and of tetrazene. The precise relative concentrations of dinitrobenzofuroxan salt and of tetrazene may, however, vary in practice in more or less great proportions which will be a function of the mechanical environment of the charge, that is to say of the precise nature and shape of the case employed for the cartridge, and of the nature of the powder employed in this cartridge.

In general, an explosive mixture containing a preponderant proportion of dinitrobenzofuroxan salt would be used. Most of the time the dinitrobenzofuroxan salt will be involved in the composition so as to reach 40 to 70% of the total weight of the latter, and the tetrazene so as to reach 5 to 15% by weight relative to the total weight of the composition.

According to another characteristic of the present invention the pulverulent oxidizing agent consists of cupric oxide, potassium nitrate, ferric oxide, a metal salicylate, ascorbic acid, an inorganic or organic peroxide, and mixtures of these oxidants.

According to another characteristic of the present invention the pulverulent reducing agent will be chosen from calcium silicide, aluminum, iron, zinc, magnesium and mixtures thereof, and in particular mixtures based on calcium silicide.

Finally, according to another characteristic of the present invention the inert abrasive powder consists of glass powder.

According to a particular characteristic of the present invention the calcium silicide employed in the composition according to the invention will simultaneously act as pulverulent reducing agent and inert abrasive powder.

In general, the relative proportions of all the constituents will be also defined by the person skilled in the art relying on his or her general knowledge of the subject, and especially so as to obtain a composition which is suited to good processing, for example regarding the volumetric metering into the cases with annular percussion. In practice excellent results were obtained by using a mixture of glass powder and of calcium silicide, for example in equal weight mixtures.

Finally, the invention relates to a process for the manufacture of a priming charge with annular percussion, consisting in carrying out the following successive stages:

the pulverulent oxidizing agent and the pulverulent reducing agent and the inert abrasive powder are mixed dry;
the dinitrobenzofuroxan salt and the tetrazene are then added to this mixture thus formed, then
the mixture thus obtained is homogenized.

During the second operation, consisting in adding the dinitrobenzofuroxan salt and the tetrazene, a solution of binder, for example an aqueous solution of gum arabic, is also incorporated in the mixture, if necessary.

The subject of the present invention will be described below in greater detail with reference to the particular example of embodiment given below by way of illustration and to the comparative table on page 6.

EXAMPLE

The nonexplosive ingredients of the composition according to the invention are weighed out, namely the cupric oxide, the glass powder and the calcium silicide and are introduced into a rotary blender, where they are stirred so as to make the mixture homogenous. This mixture is then transferred to a planetary blender designed for wet compositions, into which the necessary quantity of water is added, and the potassium dinitrobenzofuroxan and the tetrazene (weighed beforehand) are poured onto this mixture.

At the end of the homogenization operation an aqueous solution of gum arabic is added, acting as binder.

It should be noted that the different pulverulent constituents are generally employed with a small average particle size, preferably smaller than 250 μm.

After a sufficient blending time a ready-for-use composition is obtained, corresponding to the following formulation:

| | |
|---|---|
| potassium dinitrobenzofuroxan | 55% |
| tetrazene | 11% |
| cupric oxide | 11% |
| glass powder | 11% |
| calcium silicide | 11% |
| binder: gum arabic | 1% |

Such a composition is next distributed by spreading into cases for annular percussion of 6.8-mm caliber and distributed by compression or spinning or any other mechanical means, for example with the aid of a device identical with that described in French patent application No. 91/02,011 relating to priming by oblique compression.

With the aid of an appropriate metering process, for example a volumetric one such as a hopper, a suitable mass of propellent powder is poured into each case and is optionally packed, and folding and varnishing of the cartridges are then performed. In an example of embodiment in accordance with the invention, other than that of the above sealing charges, a projectile such as a bullet is placed and crimped onto the primed case.

The cartridges obtained are next tested for their sensitivity to percussion on a firing rig corresponding to the following characteristics:

rounded-point striker, 2 mm diameter 112 g balls 300 mm drop height, the results being expressed in the number of impacts resulting in deflagration in relation to the number of impacts fired.

All the results corresponding to the example of the composition indicated above and to a certain number of other possible combinations of explosives of the prior art have been collated in the table below. These results clearly demonstrate that the problem of the sensitivity of the priming charges with annular percussion has been able to be satisfactorily solved only by resorting to the explosive mixture consisting of the potassium dinitrobenzofuroxan salt in combination with tetrazene.

It also appears that the mixture of diazodinitrophenol in combination with tetrazene gives very poor results, and that the mixture of diazodinitrophenol and of potassium dinitrobenzofuroxan gives poor results.

Finally, Example K shows that the use of the potassium dinitrobenzofuroxan salt by itself produces very poor results with cases with annular percussion.

| | DDNP | KDNBF | Tetrazene | $MnO_2$ | CuO | Fe | Al | glass | $CaSi_2$ | Failed/fired |
|---|---|---|---|---|---|---|---|---|---|---|
| A | 50.0 | — | 15.0 | 20.0 | — | 15.0 | — | — | — | 20/20 |
| B | 30.0 | — | 20.0 | — | 30.0 | — | 10.0 | 10.0 | | 24/25 |
| C | 25.0 | — | 17.0 | — | 24.0 | 09.0 | — | 25.0 | — | 25/25 |
| D | 30.0 | — | 30.0 | 20.0 | — | — | — | 20.0 | — | 17/19 |
| E | 30.0 | — | 30.0 | — | 15.0 | — | — | 25.0 | — | 17/25 |
| F | 30.0 | — | 50.0 | — | — | — | — | 20.0 | — | 12/25 |
| G | 32.0 | — | 18.0 | — | 26.0 | — | 05.0 | 19.0 | — | 13/25 |
| H | 36.5 | 24.5 | — | — | 24.0 | — | — | 08.0 | 07.0 | 09/25 |
| I | 37.0 | 09.0 | — | — | 23.7 | — | — | 12.8 | 17.5 | 02/15 |
| J | 34.8 | 27.8 | — | — | 17.8 | — | — | 09.8 | 09.8 | 02/15 |
| K | — | 50.0 | — | — | 22.0 | — | — | 16.0 | 12.0 | 13/30 |
| L | — | 48.0 | 07.5 | — | 20.0 | — | — | 13.5 | 11.0 | 00/30 |
| M | — | 55.2 | 11.2 | — | 11.2 | — | — | 11.2 | 11.2 | 00/50 |

DDNP: diazodinitrophenol
KDNBF: potassium dinitrobenzofuroxan
Binder: not taken into account in the percentage composition

I claim:

1. A priming charge with annular percussion, free from any toxic metal, having the following weight composition:

40 to 90% of an explosive mixture of a dinitrobenzofuroxan salt and of tetrazene, 5 to 30% of a pulverulent oxidizing agent, 5 to 25% of a pulverulent reducing agent.

2. The priming charge with annular percussion as claimed in claim 1, wherein the dinitrobenzofuroxan salt is an alkali or alkaline-earth metal salt.

3. The priming charge with annular percussion as claimed in claim 1 wherein the explosive mixture contains a preponderant proportion of dinitrobenzofuroxan salt.

4. The priming charge with annular percussion as claimed in claim 3, wherein the dinitrobenzofuroxan salt represents from 40 to 70% by weight of the total composition and the tetrazene 5 to 15% by weight of the total composition.

5. The priming charge with annular percussion as defined in claim 1 further comprising up to 25% of an inert abrasive powder.

6. The priming charge with annular percussion defined by claim 1 further comprising up to 5% of a binder.

7. The priming charge with annular percussion defined by claim 5 further comprising up to 5% of a binder.

8. The priming charge with annular percussion as defined in claim 2 wherein the explosive mixture contains a preponderant proportion of dinitrobenzofuroxan salt.

9. A process for the manufacture of a priming charge with annular percussion as claimed in one of claims 1, 2 and 4 wherein the following successive stages are carried out:

the pulverulent oxidizing agent and the pulverulent reducing agent and the inert abrasive powder are mixed dry;

the dinitrobenzofuroxan salt and the tetrazene are then added to this mixture thus formed, then the mixture thus obtained is homogenized.

10. The process as claimed in claim 9, wherein during the operation adding the dinitrobenzofuroxan salt and the tetrazene, a solution of binder is also incorporated into the mixture.

11. The priming charge with annular percussion as claimed in claim 10 wherein the solution of binder is an aqueous solution of gum arabic.

12. The priming charge with annular percussion as claimed in one of claims 1, 2, 4, 5, 6, 7, 8 or 11 wherein the pulverulent reducing agent is chosen from calcium silicide, aluminum, iron, zinc, magnesium and mixtures thereof.

13. The priming charge with annular percussion as claimed in one of claims 1, 2, 4, 5, 6, 7, 8 or 11 wherein the inert abrasive powder consists of glass powder.

14. The priming charge with annular percussion as claimed in one of claims 1, 2, 4, 5, 6, 7, 8 or 11 wherein the calcium silicide acts at the same time as pulverulent reducing agent and as abrasive powder.

15. The priming charge with annular percussion as claimed in one of claims 1, 2, 4, 5, 6, 7, 8 or 11 which corresponds to the following weight composition:

40 to 70% of potassium dinitrobenzofuroxan,
5 to 15% of tetrazene
5 to 30% of cupric oxide,
5 to 25% of calcium silicide,
5 to 25% of glass powder, and
0 to 5% of binder.

16. The priming charge with annular percussion as claimed in one of claims 1, 2, 4, 5, 6, 7, 8 or 11 wherein the pulverulent oxidizing agent is chosen from cupric oxide, potassium nitrate, ferric oxide, a metal salicylate, ascorbic acid, an inorganic or organic peroxide and mixtures of these oxidants.

* * * * *